US011600288B2

(12) United States Patent
Tamaru

(10) Patent No.: US 11,600,288 B2
(45) Date of Patent: Mar. 7, 2023

(54) SOUND SIGNAL PROCESSING DEVICE

(71) Applicant: Sony Interactive Entertainment Inc., Tokyo (JP)

(72) Inventor: Yoshihiko Tamaru, Kanagawa (JP)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

(21) Appl. No.: 16/639,771

(22) PCT Filed: Aug. 23, 2018

(86) PCT No.: PCT/JP2018/031208
§ 371 (c)(1),
(2) Date: Feb. 18, 2020

(87) PCT Pub. No.: WO2019/044664
PCT Pub. Date: Mar. 7, 2019

(65) Prior Publication Data

US 2020/0184988 A1 Jun. 11, 2020

(30) Foreign Application Priority Data

Aug. 28, 2017 (JP) ..... JP2017-163240

(51) Int. Cl.
*G10L 21/0232* (2013.01)
*H04R 3/02* (2006.01)
*G10L 21/0208* (2013.01)

(52) U.S. Cl.
CPC ..... *G10L 21/0232* (2013.01); *H04R 3/02* (2013.01); *G10L 2021/02082* (2013.01)

(58) Field of Classification Search
CPC ..... H04M 9/082; H04M 3/002; G10L 2021/02082; G10L 19/02; H04R 3/02
(Continued)

(56) References Cited

U.S. PATENT DOCUMENTS 6,437,230 B2 * 8/2002 Torii ..... G10H 1/0091 381/103
8,761,386 B2 6/2014 Fujita
(Continued)

FOREIGN PATENT DOCUMENTS

JP 2004228939 A 8/2004
JP 2007251347 A 9/2007
(Continued)

OTHER PUBLICATIONS

International Search Report for corresponding PCT Application No. PCT/JP2018/031208, 2 pages, dated Oct. 16, 2018.
(Continued)

*Primary Examiner* — Norman Yu
(74) *Attorney, Agent, or Firm* — Matthew B. Dernier, Esq.

(57) ABSTRACT

A sound signal processing device that acquires a collected-sound signal obtained by sampling a sound collected by a microphone at a first sampling frequency, and receives a reproduced-sound signal obtained by sampling a sound for reproduction at a second sampling frequency different from the first sampling frequency, and then converts the sampling frequency of the reproduced-sound signal into the first sampling frequency so as to remove an acoustic echo from the collected-sound signal by using the reproduced-sound signal whose sampling frequency has been converted.

11 Claims, 2 Drawing Sheets

(58) Field of Classification Search
USPC ..... 381/66, 94.3; 704/21.002, 205; 379/406.01, 406.05, 406.12; 455/570, 455/63.1
See application file for complete search history.

(56) References Cited

U.S. PATENT DOCUMENTS

| | | | | |
|---|---|---|---|---|
| 2004/0028217 | A1* | 2/2004 | Ebenezer | H04M 9/08 379/406.01 |
| 2005/0157866 | A1* | 7/2005 | Marton | H04M 9/08 379/406.08 |
| 2009/0252343 | A1* | 10/2009 | Mao | H04M 9/082 381/66 |
| 2010/0017205 | A1* | 1/2010 | Visser | G10L 21/02 704/225 |
| 2012/0163580 | A1* | 6/2012 | Fujita | H04M 9/082 379/406.1 |
| 2014/0307882 | A1* | 10/2014 | LeBlanc | H04S 7/305 381/66 |

FOREIGN PATENT DOCUMENTS

| | | | |
|---|---|---|---|
| JP | 2007300552 | * | 11/2007 |
| JP | 2007300552 | A | 11/2007 |
| JP | 2012049689 | A | 3/2012 |
| JP | 2012134923 | A | 7/2012 |

OTHER PUBLICATIONS

International Preliminary Report on patentability and Written Opinion for corresponding PCT Application No. PCT/JP2018/031208, 12 pages, dated Mar. 12, 2020.
Notice of Reason for Refusal for corresponding JP Application No. 2019-539433, 10 pages, dated Jan. 13, 2021.

* cited by examiner

SOUND SIGNAL PROCESSING DEVICE

TECHNICAL FIELD

The present invention relates to a sound signal processing device that processes a sound signal of a sound collected by a microphone.

BACKGROUND ART

An electronic device including both a speaker that reproduces a sound and a microphone that collects a sound is known. In such an electronic device, an acoustic echo may occur when a microphone collects a sound reproduced by a speaker. Therefore, there are cases where echo removal processing is performed on the sound signal obtained by the microphone. The echo removal processing is processing of removing a sound signal due to an echo from a sound signal output from a microphone by using sound signal data to be input to the speaker.

SUMMARY

In the case of performing the echo removal processing as described above, it is necessary that the sound signal to be input to the speaker and the sound signal obtained from the microphone have the same sampling frequency. Therefore, the existing electronic device is designed so that the sampling frequencies of both sound signals agree with each other. However, there are cases where increasing the sampling frequency of the sound signal is not desirable, particularly in the case where the sound signal of a sound collected by the microphone is transmitted to another device by wireless communication.

The present invention has been made in consideration of the above circumstances, and one of its purposes is to provide a sound signal processing device capable of performing echo removal processing while keeping the sampling frequency of a sound signal obtained by a microphone relatively low.

A sound signal processing device according to the present invention has a feature of including an acquisition section that acquires a collected-sound signal obtained by sampling a sound collected by a microphone at a first sampling frequency, a frequency conversion section that receives a reproduced-sound signal obtained by sampling a sound for reproduction at a second sampling frequency different from the first sampling frequency, and converts a sampling frequency of the reproduced-sound signal to the first sampling frequency, and an echo removal section that removes an acoustic echo from the collected-sound signal acquired by the acquisition section by using the reproduced-sound signal whose sampling frequency has been converted by the frequency conversion section.

A sound signal processing method according to the present invention has a feature of including a step of acquiring a collected-sound signal obtained by sampling a sound collected by a microphone at a first sampling frequency, a step of receiving a reproduced-sound signal obtained by sampling a sound for reproduction at a second sampling frequency different from the first sampling frequency, and converting a sampling frequency of the reproduced-sound signal to the first sampling frequency, and a step of removing an acoustic echo from the acquired collected-sound signal by using the reproduced-sound signal whose sampling frequency has been converted.

DESCRIPTION OF EMBODIMENT

Hereinafter, an embodiment of the present invention will be described in detail with reference to the drawings.

Figure 1:
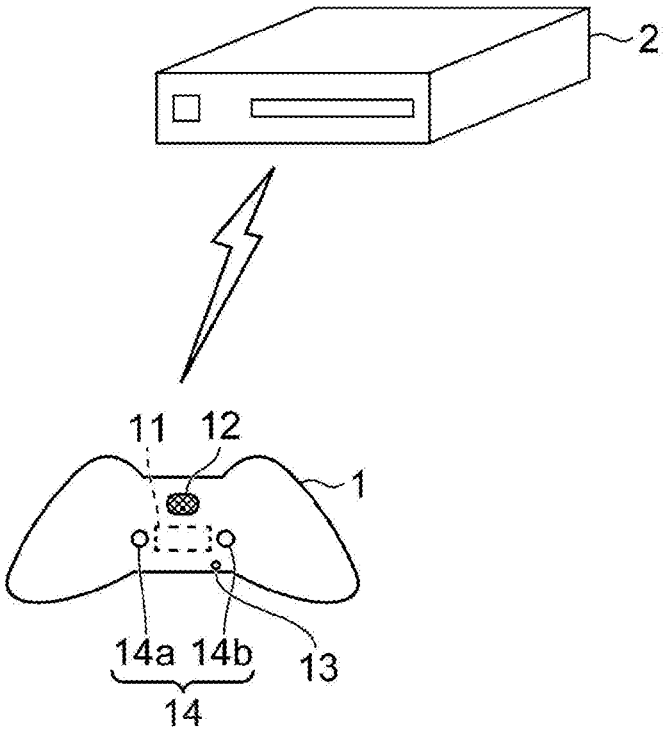
FIG. 1 is an overall configuration diagram of a system including a sound signal processing device according to an embodiment of the present invention.

FIG. 1 is an overall configuration diagram of an information processing system including a sound signal processing device 1 according to an embodiment of the present invention. In the present embodiment, the sound signal processing device 1 is assumed to be a controller of a home video game machine, and is connected to a host device 2 (here, the home video game machine main body) by wireless communication. To be specific, it is assumed that the sound signal processing device 1 and the host device 2 transmit and receive data by wireless communication based on Bluetooth (registered trademark) standards.

The sound signal processing device 1 includes a signal processing circuit 11, a speaker 12, a headphone terminal 13, and a microphone 14. On the basis of the sound signal received from the host device 2, the signal processing circuit 11 causes a sound to be emitted from either headphones connected to the headphone terminal 13 or the speaker 12. Further, the sound signal processing device 1 transmits a sound signal obtained by collecting a sound by the microphone 14 to the host device 2. In the present embodiment, it is assumed that the speaker 12 reproduces sound monaurally, and the headphone terminal 13 can be connected to both monaural reproduction compatible headphones and stereo reproduction compatible headphones. Further, the microphone 14 is a microphone array constituted by two microphone elements 14*a* and 14*b*.

Hereinafter, a sound signal transmitted from the host device 2 to the sound signal processing device 1 for reproduction by the speaker 12 or the headphones is referred to as a reproduced-sound signal. On the other hand, the sound signal obtained by the microphone 14 collecting a sound is called a collected-sound signal. Further, the sampling frequency of the reproduced-sound signal is expressed as fs, and the sampling frequency of the collected-sound signal is expressed as fm. In the present embodiment, it is assumed that fs and fm are different from each other, and fs>fm is satisfied. For example, the sampling frequency fs of the reproduced-sound signal may be 48 kHz, and the sampling frequency fm of the collected-sound signal may be 24 kHz. The reason why the sampling frequency fm of the collected-sound signal is set to a small value is that high sound quality is not required as compared with the sound signal for reproduction, and the communication band required for transmission to the host device 2 can be kept low.

Figure 2:
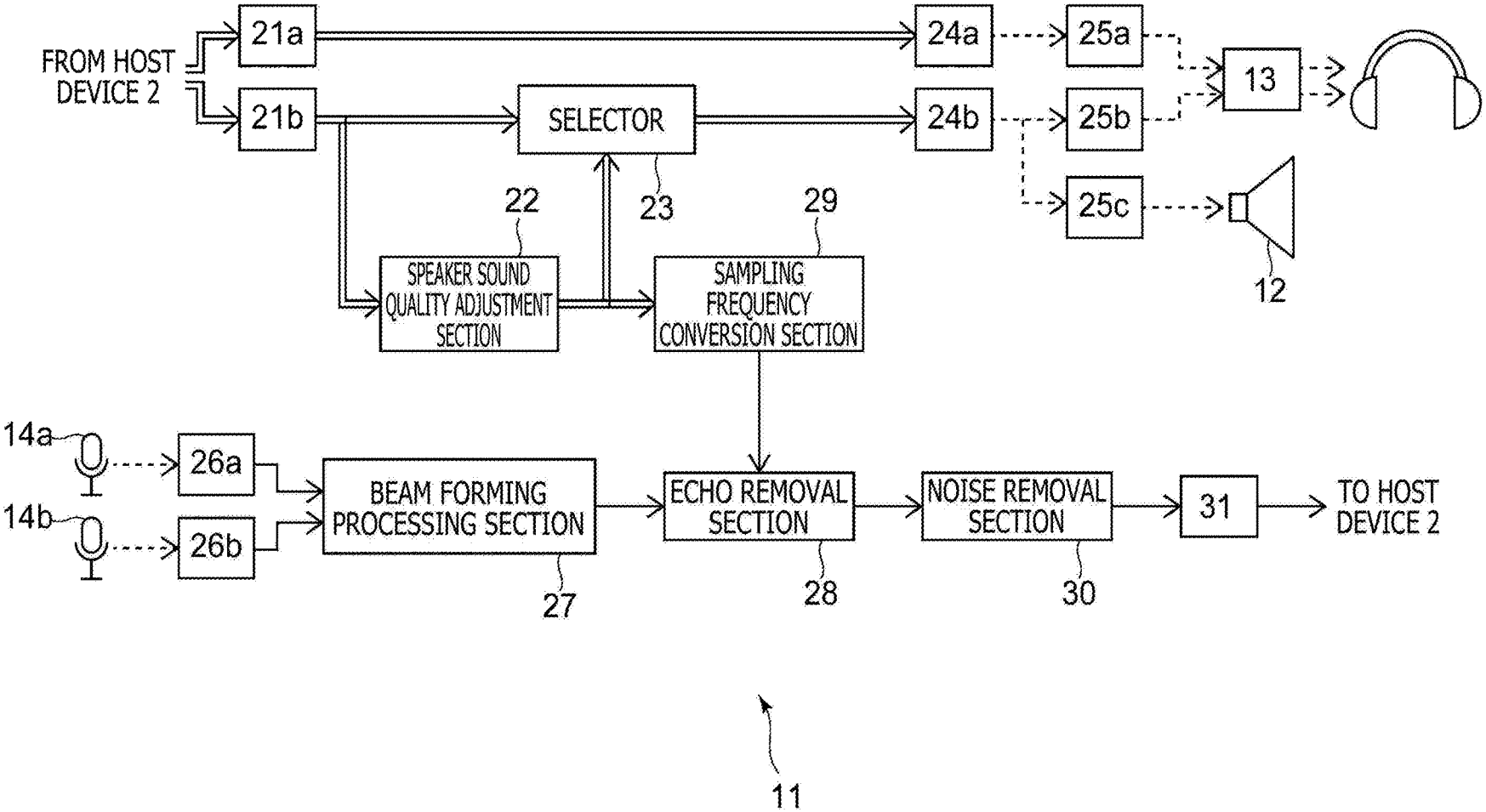
FIG. 2 is a circuit configuration diagram of the sound signal processing device according to the embodiment of the present invention.

In the present embodiment, the signal processing circuit 11 executes various sound signal processing including echo removal processing. Hereinafter, the circuit configuration of the sound signal processing device 1 will be described with reference to FIG. 2. In FIG. 2, a transmission line through which a digital sound signal having a sampling frequency fs is transmitted is denoted by a double line (two solid lines), and a transmission line through which a digital sound signal having a sampling frequency fm is transmitted is denoted by a single solid line. Further, a transmission line through which an analog sound signal is transmitted is denoted by a broken line.

As illustrated in FIG. 2, the signal processing circuit 11 includes two signal input units 21*a* and 21*b*, a speaker sound quality adjustment section 22, a selector 23, two digital-to-analog (D/A) converters 24*a* and 24*b*, and three amps (amplifiers) 25*a*, 25*b*, and 25*c*, two analog-to-digital (A/D) converters 26*a* and 26*b*, a beam forming processing section 27, an echo removal section 28, a sampling frequency conversion section 29, a noise removal section 30, and a signal output unit 31. The functions of the speaker sound quality adjustment section 22, the beam forming processing section 27, the echo removal section 28, the sampling frequency conversion section 29, and the noise removal section 30 may be all accomplished by a single processor such as a digital signal processor, or by a plurality of processors.

First, the contents of signal processing for the sound signal processing device 1 to reproduce a sound by the headphones or the speaker 12 will be described. The host device 2 transmits stereo (2-channel) digital data to the sound signal processing device 1 as reproduced-sound signals. Among these, L (left) channel data is input to the signal input unit 21*a*, and R (right) channel data is input to the signal input unit 21*b*.

The reproduced-sound signal of the L channel having been input to the signal input unit 21*a* is input to the D/A converter 24*a* as it is. On the other hand, the reproduced-sound signal of the R channel having been input to the signal input unit 21*b* is input to the selector 23 and the speaker sound quality adjustment section 22. The speaker sound quality adjustment section 22 executes processing for improving the sound quality of sound reproduced by the speaker 12 in the case where no headphones are connected to the headphone terminal 13 (that is, in the case where sound is reproduced by the speaker 12). To be specific, the speaker sound quality adjustment section 22 performs predetermined equalizer processing, compressor processing, and the like on the reproduced-sound signal. The reproduced-sound signal adjusted by the speaker sound quality adjustment section 22 is input to each of the selector 23 and the sampling frequency conversion section 29 to be described later.

The selector 23 selects a reproduced-sound signal to be supplied to the D/A converter 24*b*. To be specific, in the case where headphones are connected to the headphone terminal 13, the selector 23 inputs the reproduced-sound signal of the R channel having been input to the signal input unit 21*b* to the D/A converter 24*b* as it is. On the other hand, in the case where no headphones are connected to the headphone terminal 13, the selector 23 inputs the reproduced-sound signal adjusted by the speaker sound quality adjustment section 22 for reproduction by the speaker 12 to the D/A converter 24*b*.

The D/A converters 24*a* and 24*b* convert the digital reproduced-sound signals having been input, into analog signals and supply the analog signals to corresponding amplifiers respectively. To be specific, the analog sound signal output from the D/A converter 24*a* is amplified by the amplifier 25*a* and a sound is reproduced from the signal by the headphones connected to the headphone terminal 13. In addition, in the case where headphones are connected to the headphone terminal 13, the analog sound signal output from the D/A converter 24*b* is amplified by the amplifier 25*b* and a sound is reproduced from the signal by the headphones. In the case where no headphones are connected to the headphone terminal 13, the analog sound signal output from the D/A converter 24*b* is amplified by the amplifier 25*c* and a sound is reproduced from the signal by the speaker 12.

Incidentally, in the case where the headphones connected to the headphone terminal 13 are monaural reproduction compatible headphones, the L channel reproduced-sound signal may be used for reproduction by the headphones, and the R channel reproduced-sound signal may be used for reproduction by the speaker 12 simultaneously. In this case, even when headphones are connected to the headphone terminal 13, the selector 23 selects the reproduced-sound signal adjusted by the speaker sound quality adjustment section 22 as the input.

In summary, the reproduced-sound signal having been input to the signal input unit 21*a* is always used for reproduction by headphones connected to the headphone terminal 13 by passing through the D/A converter 24*a* and the amplifier 25*a*. On the other hand, the reproduced-sound signal having been input to the signal input unit 21*b* is processed through one of the following two paths. That is, in the case where stereo reproduction compatible headphones are connected to the headphone terminal 13, the reproduced-sound signal having been input to the signal input unit 21*b* is used for reproduction by the headphones after passing through the selector 23, the D/A converter 24*b*, and the amplifier 25*b*. On the other hand, in the case where a sound is reproduced by the speaker 12, the reproduced-sound signal having been input to the signal input unit 21*b* is used for reproduction by the speaker after passing thorough the speaker sound quality adjustment section 22, the selector 23, the D/A converter 24*b*, and the amplifier 25*c*.

As described above, the reproduced-sound signal processed in the path from the signal input units 21*a* and 21*b* to the D/A converters 24*a* and 24*b* described above is digital sound data having the sampling frequency fs. The digital sound data having a sampling frequency fs is input also to the sampling frequency conversion section 29.

Next, processing of the collected-sound signal made by the microphone 14 collecting a sound will be described. The analog collected-sound signals output from the microphone elements 14*a* and 14*b* respectively are converted into digital data by the A/D converters 26*a* and 26*b*. As described above, the A/D converters 26*a* and 26*b* convert the collected-sound signal into digital sound data having a sampling frequency fm. The beam forming processing section 27 generates collected-sound signal data having directivity on the basis of the collected-sound signal data output from each of the A/D converters 26*a* and 26*b*. In the subsequent processing, the collected-sound signal data generated by the beam forming processing section 27 is used as sound data of a sound collected by the microphone 14. That is, the A/D converters 26*a* and 26*b* and the beam forming processing section 27 function as an acquisition section that acquires a collected-sound signal obtained by sampling a sound collected by the microphone 14 at the sampling frequency fm.

Further, the echo removal section 28 performs echo removal processing on the collected-sound signal data generated by the beam forming processing section 27. This is processing of removing an acoustic echo generated by the microphone 14 collecting the sound reproduced by the speaker 12 from the collected-sound signal. In order to perform this echo removal processing, it is necessary to acquire a reproduced-sound signal indicating the content of the sound to be reproduced by the speaker 12 at the same sampling frequency as that of the collected-sound signal. Therefore, in the present embodiment, the sampling frequency conversion section 29 converts the reproduced-sound signal with the sampling frequency fs output from the speaker sound quality adjustment section 22 into a digital sound signal with the sampling frequency fm, and supplies the digital sound signal to the echo removal section 28. Specifically, the sampling frequency conversion section 29 performs a downsampling processing on the digital data of the reproduced-sound signal. As a result, a reproduced-sound signal having a sampling frequency fm is obtained. The echo removal section 28 performs echo removal processing on the collected-sound signal having the sampling frequency fm by using the reproduced-sound signal having the sampling frequency fm.

The echo removal section 28 executes the echo removal processing only in the case where the sound is reproduced by the speaker 12, and in the case where the reproduced-sound signal output from the D/A converter 24*b* is used for reproduction by the headphones, there is no need to execute echo removal processing. In the case where a sound is reproduced by the speaker 12, the sound is always adjusted by the speaker sound quality adjustment section 22. Therefore, it is sufficient if the sampling frequency conversion section 29 executes the sampling frequency conversion processing using the adjusted sound signal as an input only while the speaker sound quality adjustment section 22 executes the adjustment processing.

The noise removal section 30 executes noise removal processing for removing a noise and the like on the collected-sound signal after the echo removal, output from the echo removal section 28. Then, the data of the collected-sound signal obtained as a result of the noise removal processing is output to the signal output unit 31. The signal output unit 31 transmits the collected-sound signal data output from the noise removal section 30 to the host device 2. Since the sampling frequency of the data of the collected-sound signal to be transmitted is fm, the communication band required at the time of transmission can be reduced compared to the sound signal data of the sampling frequency fs.

According to the sound signal processing device 1 related to the embodiment of the present invention described above, the echo removal processing can be executed for the collected-sound signal using the reproduced-sound signal while the reproduced-sound signal and the collected-sound signal are processed at different sampling frequencies from each other. Therefore, the sampling frequency of the collected-sound signal can be suppressed to be lower than the sampling frequency of the reproduced-sound signal. By reducing the sampling frequency of the collected-sound signal, the communication band necessary for transmission to the host device 2 can be suppressed, or the amount of data of the collected-sound signal that is the target of processing executed by the echo removal section 28, the noise removal section 30, or the like can be reduced.

Note that the embodiment of the present invention is not limited to the above-described embodiment. Although the sound signal processing device 1 is a controller of a home video game machine, for example, in the above description, the sound signal processing device 1 is not limited to this, and may include various devices such as an electronic device having a speaker and a microphone in a same housing, or an electronic device in which a speaker and a microphone can be connected to each other so that the speaker and the microphone are close to each other. Further, the sound signal processing device 1 may transmit and receive sound signals to and from various host devices 2, in addition to the game machine main body.

Furthermore, the circuit configuration diagram described above is merely an example, and the flow of the signal processing may be different from that described above. For example, the echo removal section 28 may perform echo removal processing on the collected-sound signal of a sound collected by a single microphone element. In addition, echo removal processing may be performed on each of a plurality of collected-sound signals obtained by a plurality of microphone elements. Further, in the case where the speaker sound quality adjustment section 22 is not present, the sampling frequency conversion section 29 may directly use a reproduced-sound signal received from an external communication device as a processing target for the downsampling processing.

In the above description, the configuration is made so that the speaker reproduces a monaural sound, and the sampling frequency conversion section 29 causes only the reproduced-sound signal of one channel that is to be used for reproduction by the speaker to be subjected to frequency conversion processing. However, in some cases, the speaker 12 is compatible with stereo reproduction or the like, and reproduces sounds of a plurality of channels simultaneously. In such a case, the sampling frequency conversion section 29 may synthesize the reproduced-sound signals of a plurality of channels to be used for reproduction by the speaker 12 to convert the sampling frequency to fm. In such a way, the echo removal section 28 can execute the echo removal processing using the reproduced-sound signal output from the sampling frequency conversion section 29, similarly to in the case of one channel.

REFERENCE SIGNS LIST

1 Sound signal processing device, 2 Host device, 11 Control circuit, 12 Speaker, 13 Headphone terminal, 14 Microphone, 14*a*, 14*b* Microphone element, 21*a*, 21*b* Signal input unit, 22 Speaker sound quality adjustment section, 23 Selector, 24*a*, 24*b* D/A converter, 25*a*, 25*b*, 25*c* Amplifier, 26*a*, 26*b* A/D converter, 27 Beam forming processing section, 28 Echo removal section, 29 Sampling frequency conversion section, 30 Noise removal section, 31 Signal output unit.

The invention claimed is:

1. A sound signal processing device comprising:

an acquisition section that acquires a collected-sound signal obtained by sampling a sound collected by a microphone at a first sampling frequency;

a reception unit that receives a reproduced-sound signal obtained by sampling a sound for reproduction at a second sampling frequency different from the first sampling frequency, where the reproduced-sound signal is a stereo signal having a first output channel and a second output channel for connection to respective first and second input channels of stereo headphones for a user in a physical space;

a speaker sound quality adjustment section for producing an improved sound quality signal by performing equalization from only the second output channel of the reproduced-sound signal, wherein the improved sound quality signal is for connection to a speaker, separate from the stereo headphones in the physical space;

a frequency conversion section that produces a converted improved sound quality signal by converting the second sampling frequency of the improved sound quality signal to the first sampling frequency; and an echo removal section that removes an acoustic echo caused by feedback from acoustic output from the speaker feeding into the microphone by cancelling such feedback as a function of the converted improved sound quality signal derived from only the second output channel of the reproduced-sound signal.

2. The sound signal processing device according to claim 1, further comprising: an output unit that transmits the collected-sound signal from which the acoustic echo has been removed by the echo removal section to an external host device.

3. A sound signal processing method comprising:

acquiring a collected-sound signal obtained by sampling a sound collected by a microphone at a first sampling frequency;

receiving a reproduced-sound signal obtained by sampling a sound for reproduction at a second sampling frequency different from the first sampling frequency, where the reproduced-sound signal is a stereo signal having a first output channel and a second output channel for connection to respective first and second input channels of stereo headphones for a user in a physical space;

producing an improved sound quality signal by performing equalization from only the second output channel of the reproduced-sound signal, wherein the improved sound quality signal is for connection to a speaker, separate from the stereo headphones in the physical space;

producing a converted improved sound quality signal by converting the second sampling frequency of the improved sound quality signal to the first sampling frequency; and removing an acoustic echo caused by feedback from acoustic output from the speaker feeding into the microphone by cancelling such feedback as a function of the converted improved sound quality signal derived from only the second output channel of the reproduced-sound signal.

4. The sound signal processing device according to claim 1, wherein the speaker sound quality adjustment section performs both equalization and compressor processing on only the second output channel of the reproduced-sound signal.

5. The sound signal processing device according to claim 1, further comprising a selector multiplexer unit that selectively provides: (i) the second output channel of the reproduced-sound signal to the second input channel of the stereo headphones when the speaker is not used to output the acoustic output; and (ii) the improved sound quality signal to the speaker when the speaker is used.

6. The sound signal processing device according to claim 5, wherein at least one of the speaker and the stereo headphones are active.

7. The sound signal processing device according to claim 5, wherein the selector multiplexer unit does not provide the improved sound quality signal to the stereo headphones.

8. The sound signal processing device according to claim 2, wherein the sound signal processing device is part of a game controller that receives the reproduced-sound signal from the host device.

9. The sound signal processing device according to claim 8, wherein the host device is a video game machine.

10. The sound signal processing device according to claim 1, wherein the first output channel of the reproduced-sound signal is for connection to the first input channel of the stereo headphones without equalization adjustment.

11. The sound signal processing device according to claim 1, further comprising a noise removal section that removes noise from the collected-sound signal after the acoustic echo is removed.

* * * * *